United States Patent [19]

Treffers

[11] 4,286,419

[45] Sep. 1, 1981

[54] BUILDING STRUCTURE AND COUPLING PROFILE ASSOCIATED THEREWITH

[76] Inventor: Willem M. Treffers, No. 34, Jacob van Lenneplaan, Baarn, Netherlands

[21] Appl. No.: 867,944

[22] Filed: Jan. 9, 1978

Related U.S. Application Data

[63] Continuation of Ser. No. 685,329, May 11, 1976, abandoned.

[30] Foreign Application Priority Data

May 15, 1975 [NL] Netherlands ..... 7505763

[51] Int. Cl.[3] ..... G09F 7/18

[52] U.S. Cl. ..... 52/39; 52/221; 98/40 D; 174/49

[58] Field of Search ..... 52/220, 221, 39; 98/40 D, 40 A; 174/48, 49

[56] References Cited

U.S. PATENT DOCUMENTS

| | | | |
|---|---|---|---|
| 2,885,943 | 5/1959 | Divizia | 98/40 A |
| 3,246,074 | 4/1966 | Neumann | 52/221 |
| 3,308,745 | 3/1967 | Davies | 98/40 D |
| 3,387,550 | 6/1958 | Thomson | 98/40 D |
| 3,409,766 | 11/1968 | Meckler | 52/220 |
| 3,742,674 | 7/1973 | Lang | 52/220 |
| 3,748,998 | 7/1973 | Lambert | 98/40 D |
| 3,974,755 | 8/1976 | Honmann | 98/40 D |

FOREIGN PATENT DOCUMENTS

| | | | |
|---|---|---|---|
| 501926 | 3/1939 | United Kingdom | 98/40 A |

*Primary Examiner*—Price C. Faw, Jr.
*Assistant Examiner*—Henry E. Raduazo
*Attorney, Agent, or Firm*—John P. Snyder

[57] ABSTRACT

U-shaped coupling profiles hold in a building structure a floating ceiling or they constitute a grating to which sound-absorbing components or lighting fittings can be secured. A number of the coupling profiles are, in addition, adapted to supply or conduct away air or to receive electric leads or to hold walls in order to render the space beneath the coupling profiles technically suitable for a given use of said space. In order that the areas of air inlet and outlet and the areas of the electric connections can be better chosen in accordance with the intended use of the space, each of the plurality of coupling profiles is appropriate for receiving in common electric leads and at least one air control.

7 Claims, 15 Drawing Figures

Figure 1:
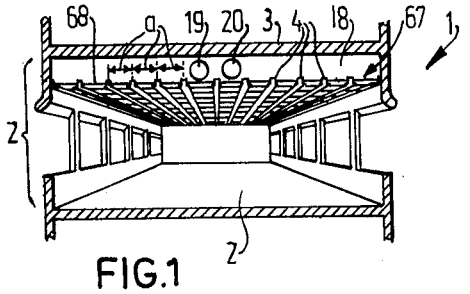

FIG.7
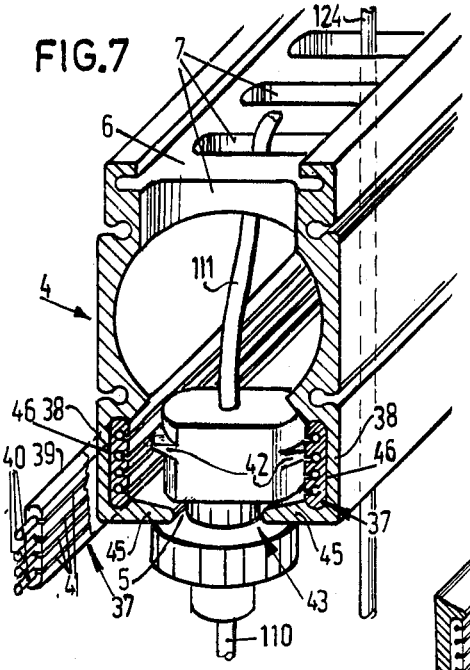
FIG. 11
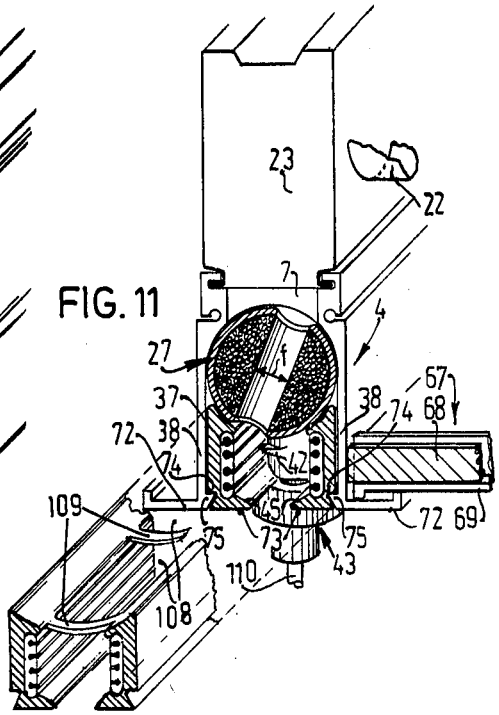
FIG.12
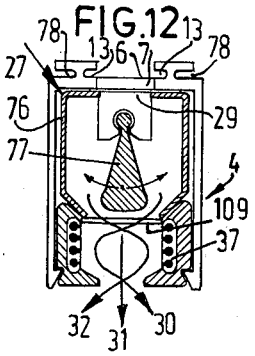
FIG.13
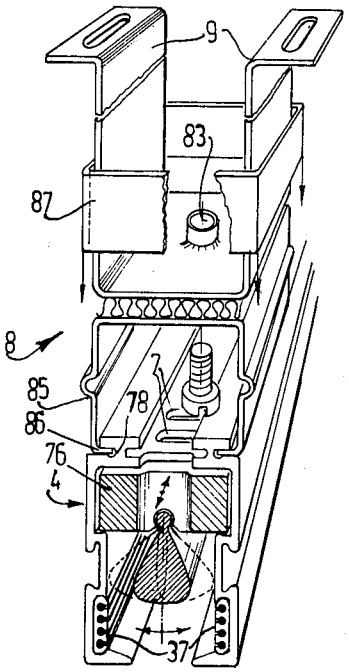
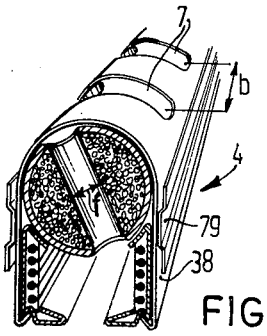
FIG.14

FIG.8
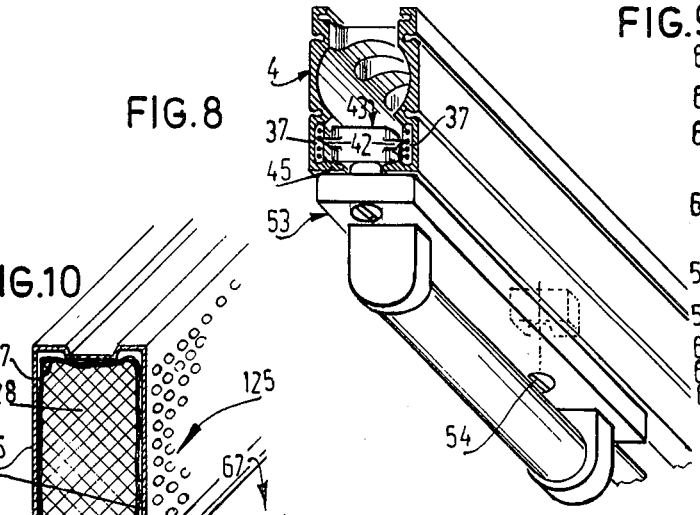
FIG.9
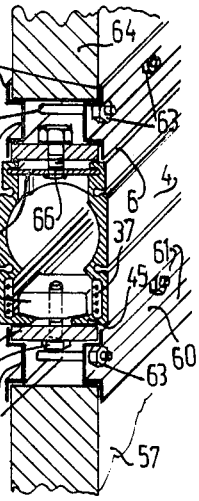
FIG.10
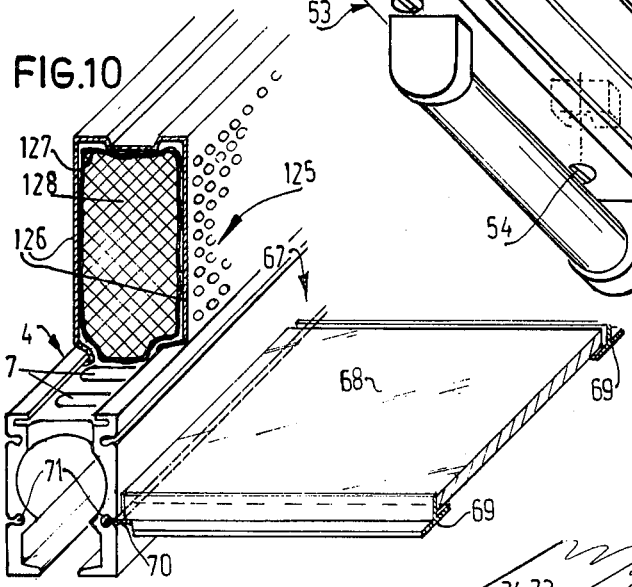
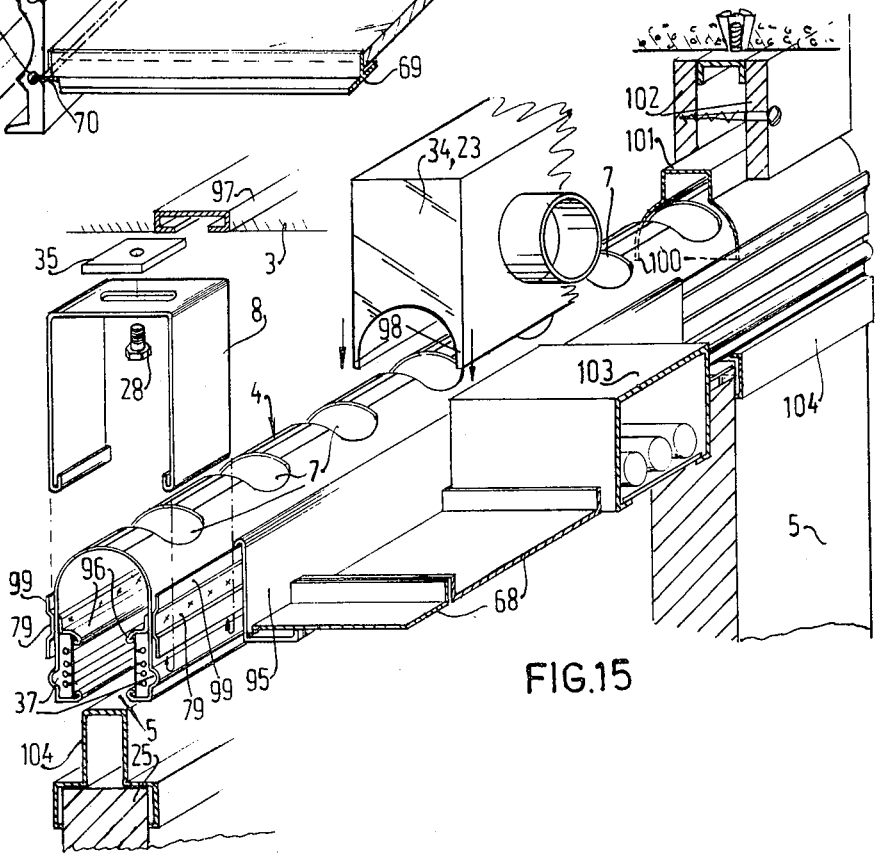
FIG.15

BUILDING STRUCTURE AND COUPLING PROFILE ASSOCIATED THEREWITH

This is a continuation of application Ser. No. 685,329 filed May 11, 1976, and now abandoned.

The invention relates to a building structure comprising a plurality of identical coupling profiles suspended to a ceiling surface and having each a substantially U-shaped profile and at least one air passage and being open on the bottom side.

Such a building structure is known. The coupling profiles hold therein a floating ceiling or they constitute a grating to which sound-absorbing components or lighting fittings can be secured. A number of the coupling profiles are, in addition, adapted to supply or conduct away air or to receive electric leads or to hold walls in order to render the space beneath the coupling profiles technically suitable for a given use of said space.

The invention provides a building structure in which the areas of air inlet and outlet and the areas of the electric connections can be better chosen in accordance with the intended use of the space. The building structure according to the invention is characterized in that each of the plurality of coupling profiles is appropriate for receiving in common electric leads and at least one air control.

Since each one of the plurality of coupling profiles may be employed for feeding or draining air and for receiving electric leads, it is possible to supply air and to conduct it away to the space and away therefrom at substantially any desired area, whilst, moreover, the connections for electric conductors, for example, of the electric mains, the telephone, the computer terminals and/or aerial leads and for lighting fittings, clocks, etc. can be made at any desired place of any coupling profile even after the building has been completed according to the division and the use of the various parts of the space. Therefore, a displacement of air inlets and outlets and of electric connections can be readily carried out if it is desired in the event of a change of the division and/or the use of the space. An air inlet at any given place is not an obstacle for making an electric connection at the same place.

The invention provides furthermore a coupling profile apparently intended for use in a building structure in accordance with the invention, said profile having a substantially channel-section and an air passage and being open on the bottom side. This coupling profile is characterized in that it is suitable for receiving in common electric conduits and at least one air control.

The aforesaid and further features of the invention will be described more fully hereinafter with reference to a drawing.

Figure 4:
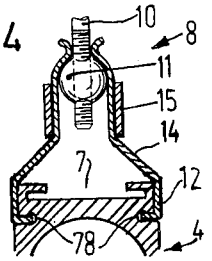
Figure 3:
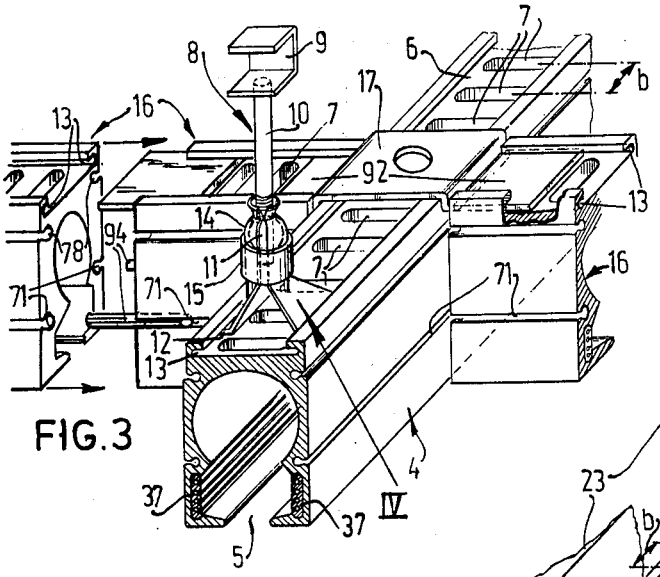
Figure 6:
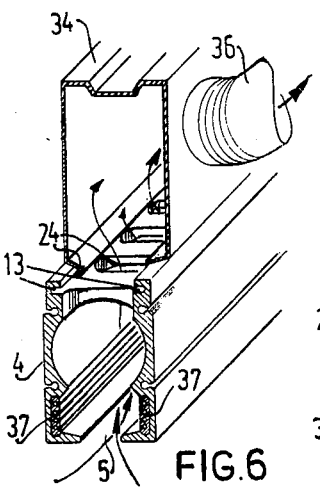
Figure 5:
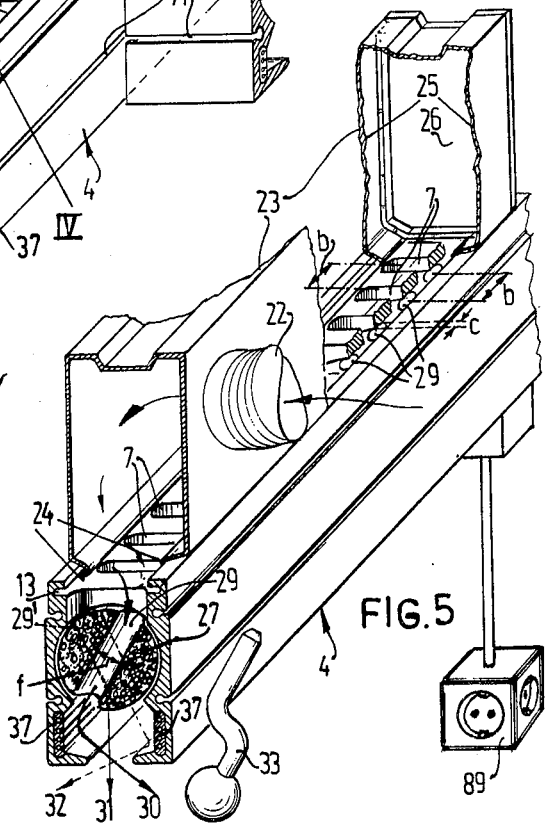
Figure 2:
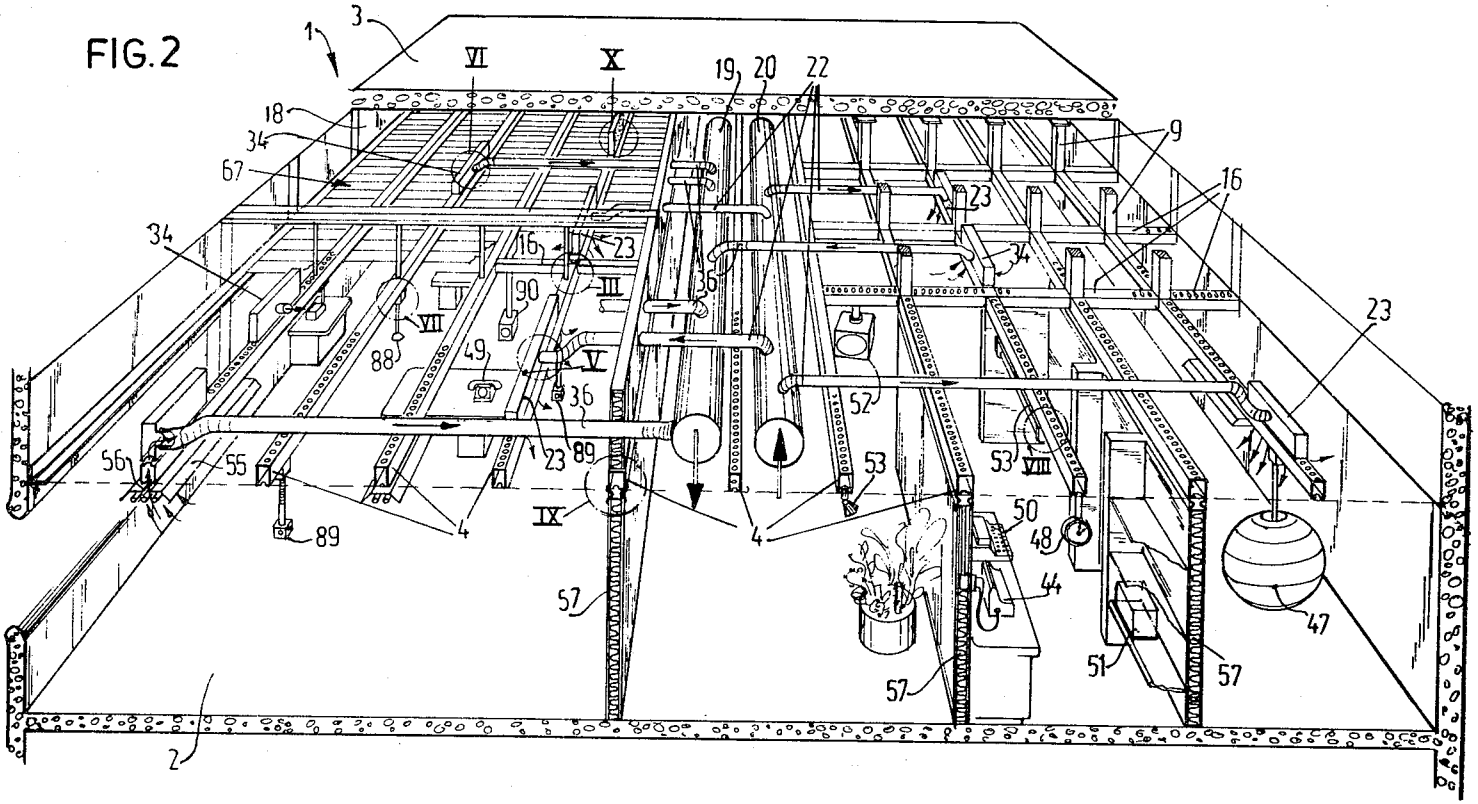

In the drawing:

FIG. 1 is a perspective view of a space not yet subdivided in accordance with the invention, FIG. 2 is an enlarged perspective view, partly broken away, of a subdivided space as shown in FIG. 1, FIG. 3 is an enlarged view of a detail III in FIG. 2, FIG. 4 shows a variant of a detail IV in FIG. 3, FIG. 5 is an enlarged view of the detail V in FIG. 2, FIG. 6 is an enlarged view of the detail VI of FIG. 2, FIG. 7 is an enlarged view of the detail VII in FIG. 2, FIG. 8 is an enlarged view of the detail VIII in FIG. 2, FIG. 9 is an enlarged view of the detail IX in FIG. 2, FIG. 10 is an enlarged view of the detail X in FIG. 2, FIGS. 11, 12, 13 and 14 show each a variant of a differently shaped coupling profile in accordance with the invention comprising an air supply control and FIG. 15 shows a further development of the coupling profile in accordance with the invention and elements to be secured thereto.

The building structure 1 of FIG. 1 comprises a plurality of identical, parallel coupling profiles 4 of metal, for example, drawn aluminium, suspended in a space 2 at equal distances a from one another to a ceiling 3 of the building structure.

The coupling profiles 4 have a substantially channel-shaped section, are substantially open on the bottom side 5 throughout their length and have openings 7 on the top side 6 at relative distances b.

The suspension of each coupling profile 4 to the ceiling 3 of the building structure is performed by means of hangers 8 each comprising a console 9 to be rigidly screwed to the ceiling 3, a screwthreaded rod 10, suspended to the console 9 and having a spherical nut 11, a steel jacket 14 enveloping the nut 11 and extensible in a radial direction and having lips 12 engaging axial grooves 13 above the openings 7 and on either side thereof in the top side 6 of the coupling profile 4 and a locking sleeve 15 impeding a radial expansion of the jacket 14.

FIG. 4 shows that alternately the lips 12 of the jacket 14 may engage grooves 78 provided on the outer side of the coupling profile 4.

The coupling profiles 4 are interconnected by means of a plurality of transverse coupling profiles 16 having the same section as the coupling profiles 4 and bearing on the coupling profiles 4 by means of saddles 17. Strips 92 of saddles 17 engage grooves 13 of the coupling profiles 16. Portions of coupling profiles 16 and 4 can be interconnected by means of a plate 93 engaging grooves 13 and of pins 94 engaging external grooves 78 and/or 71. In the space 18 between the ceiling 3 and the coupling profiles 4 an air supply conduit 20 and an air drain conduit 21 extend parallel to the coupling profiles 4. The air supply conduit 20 communicates through tubes 22 with air supply cabinets 23, which are open on the bottom side (see FIGS. 5) and are each provided with two lips 24 engaging grooves 13. The lips 24 can be inserted into the grooves 13 by moving the walls 25 towards one another, when the covers 26 are removed. If desired, a channel 19 and/or 20, which is open on the bottom side, may be arranged in a manner not shown directly above a coupling profile 4. The covers 26 engaging the inner sides of the walls 25 hold the lips 24 in the grooves 13. An air supply control 27 is mainly formed by a roller 128 of sound-insulating material, for example, mineral wool or PVC foam, preferably cork on account of its satisfactory sound-insulating, sound-absorbing and fireproof properties, which roller is slipped in an axial direction into a coupling profile 4 as far as beneath an air supply cabinet 23. This air supply regulator 27 has round holes 29 at distances b from one another. The diameter f of the holes 29 is so small that the air emerges in a turbulent stream.

The air supply regulator 27 is displaceable in an axial direction in order to control the quantity of air flowing out of the air supply cabinet 23 through the openings 7 and the holes 29 from the bottom side 5 of the coupling profile 4 by enlarging or reducing at will the overlap c of the openings 7 and the holes 29. Since the air supply regulator 27 is, in addition, capable of directing the air stream, the air can be introduced at will into the space 2 in the direction of the arrow 30, when the holes 29 are in the position shown in FIG. 5, in a perpendicularly downward direction indicated by the arrow 31, when the holes 29 are in a vertical position, or in the direction of the arrow 32, when the holes 29 are turned into the position 29' indicated by broken lines. For this purpose the air supply regulator 27 can be turned by means of a curved key 33.

FIG. 6 shows an air drain cabinet 34 fastened on the top side of a coupling profile 4 by means of lips 24 in the grooves 13 and communicating through a tube 36 with the air drain conduit 19.

In the coupling profile 4 of FIG. 7 electric leads 37 are arranged near each of the two flanges 38 of the coupling profile 4. These leads 37 comprise a strip of insulating material 39 in which conductors 40 are embedded, each of which is accessible through a slot 41 for a contact 42 of a plug 43. The plug 43 mechanically engages the inwardly extending lower rims 45 of the flanges 38. The flanges 38 have a longitudinal cavity 46, into which elastically snaps the strip 39. The plug 43 may be connected to a downwardly extending output cable 110 and/or to an input or output cable 111 inserted through an opening 7. The cable 111 may even be passed through a hole 29 of the air supply regulator 27, which can thus not completely block the openings 7, but this is practically never required. If desired, an electric cable 124 without plug 43 may be passed through the coupling profile 4.

The conductors 40 may be associated with the electric mains for feeding electric appliances, for example, a typewriter 44, lamps 47, 53, electric clocks 48 and the like and/or with computer and/or television aerial mains. FIG. 2 shows telephones 49, a telex-writer 50, a computer terminal 51 and a television set 52 connected thereto.

FIG. 8 shows that a lighting fixture 53 is directly secured to the lower rims 45 of the coupling profile 4 by means of a plug 43 and a bolt 54 corresponding to the plug 43 and replacing the electric contacts 42.

The electric leads 37 may extend throughout the length of the space 2 inside the coupling profile 4 and need, therefore, be connected only at the end of the coupling profile 4, whilst air supply cabinets 23 and/or air drain cabinets 34 may be arranged on the same coupling profile 4. The lamp 55 of FIG. 2 even has a central recess 56 in order to allow an air drain cabinet 34 arranged above the lamp 55 to suck up air.

FIG. 9 shows a wall 57 secured to a coupling profile 4. For this purpose the lower rims 45 of the coupling profile 4 are clamped at a plurality of relative space areas by means of a screw bolt 66 between a rectangular nut 58 and a filling profile 59, whilst two clamping plates 60 interconnected by means of bolts 62 and nuts 63 engage the profile 59 and the wall 57 by rims 61. On the top side 6 of the coupling profile 4 a sound-insulating partition 64 is connected in the same manner with the coupling profile 4, that is to say, by means of a nut 65 engaging the grooves 13, a filling profile 59, a screw bolt 66 and clamping plates 60 with bolts 62 and nuts 63.

The walls 57 and partitions 64 can be readily displaced upwardly, whilst the air inlet and outlet as well as the aforesaid apparatus can be readily connected in a simple manner at an appropriate, difference place. The connecting areas and the disposition of the walls 57 may be chosen in an advanced stage of the building operations, that is to say, immediately before the space 2 is occupied, and, in addition, they can be adapted to an optimum extent to varying operational conditions with minimum effort and without breaking up the structure.

The space 2 is preferably separated by a floating ceiling 67 from the space 18 by means of ceiling slabs 68, which are held by means of bearings 69 at their ends 70 in external grooves 71 of the coupling profiles 4 (FIG. 10). Independently of the presence or absence of ceiling slabs 68 the coupling profiles 4 may be provided with sound absorbers 125 for deadening the sound from the space 18, each of which is formed by a cabinet open on the bottom side and having perforated walls 126 and receiving a flexible bag 127, for example, of a synthetic resin, filled with mineral wool 128. The sound from the space 18 passes through the coupling profile 4 into the sound absorbers 125, where it is absorbed.

As the case may be, girders 69 or ceiling slabs 68 are bearing on the top sides 6 of the coupling profiles 4 or on outwardly extending rims 72 of differently shaped coupling profiles 4.

The coupling profile 4 shown in FIG. 11 comprises two bracing rails 73 interconnected by bridge pieces 109 leaving free the air passages 108 and embracing an air supply regulator 27, each rail accommodating a set of electric leads 37, each rail having an inwardly extending lower rim 45 and each rail gripping by a rim 74 behind a lower rim 75 of a flange 38. FIG. 11 illustrates that at one and the same place of the space one and the same coupling profile 4 may be provided with an electric connection and, in addition, with an air inlet. The plug 43 can be connected with the electric leads 37 at any place of the coupling profile 4 shown in the other Figures. FIG. 5, for example, shows that beneath the air supply regulator 27 a plug-socket 89 can be suspended.

FIG. 12 shows a coupling profile 4 substantially similar to that shown in FIG. 11. However, the air supply regulator 27 is formed in this case by a slide 76 having a substantially rectangular profile with holes 29, whilst the directions 30, 31 and 32 of the air stream are determined by the position of a tongue profile 77 pivotally suspended to the slide 76. For securing air cabinets 23 or 24 the top side 6 of this coupling profile 4 has internal grooves 13 and external grooves 78.

FIG. 13 shows a coupling profile 4 very similar to that of FIG. 12, the slide 76 being, however, made, for example, from sound-absorbing material instead of being made of sheet material. FIG. 13 furthermore shows a variant of a hanger 8 for a swing-free connection of the coupling profile 4. This hanger 8 comprises a console 9 having a tapped hole 83 receiving a bolt 84 passed across a U-shaped clamping piece 85. The clamping piece 85 has two inwardly extending rims 86 engaging external grooves 78 of the coupling profile 4, a ring 87 adapted to slide around the clamping piece 85 preventing a departure of the latter.

FIG. 14 shows a coupling profile 4 of sheet material whose flanges 38 are provided on the outer side with spot-welded fastening strips 79 for securing in place air cabinets 23 and/or 34, for suspending the coupling profile 4 to the ceiling 3 and for holding girders 69 or supporting profiles 9 (see FIG. 3).

Like a plug 43, a pull switch 88, a hanging plug-socket 89, an electric wall clock 48 and the like (see FIG. 2) may be suspended to the lower rims 45.

The steel-sheet coupling profile 4 shown in FIG. 15 is provided with spot-welded strips 79 and 96. The strips 96 accommodate electric leads 37, whereas the strips 79 serve to suspend the coupling profile 4 by means of a U-shaped hanger 8, secured by a bolt 28 to a suspension plate 35, which is displaceable in a profile 97 embedded in the ceiling 3 of the structure.

The lower rims 98 of an air outlet cabinet 34 or an air inlet cabinet 23 can be held in place by the upper rims 99 of strips 79 as well as lower rims 100 of a transitional profile 101 for fastening sound-insulating slabs 102.

Supporting profiles 95 can be suspended to the strips 79. These supporting profiles 95 may hold ceiling slabs 68 and/or lighting fixtures 103.

The lower side of the coupling profile 4 may be provided with a transitional profile 104, which holds a wall 25.

What I claim is:

1. In a building structure, a suspended grid system comprising a plurality of elongate, identical coupling profiles, each of substantially channel-shaped section open at the bottom, each coupling profile having a series of spaced openings in its top, an air regulator device freely axially positioned within the length of at least one coupling profile at a desired location and cooperating with the openings at said location to pass conditioned air at said desired location while leaving those openings beyond said location free to pass return air, a conditioned air inlet cabinet mounted on top of said one coupling profile at said desired location, said cabinet being open along its bottom to pass conditioned air through said openings at said desired location to and through said air regulator device, said one coupling profile carrying electric leads adjacent the open bottom thereof, and at least one electrical connection device freely axially positioned along the length of said one coupling profile at a particular location and cooperating with the electrical leads at such particular location to provide electrical outlet connection thereat, the air supply regulator being formed by a roller of sound-insulating material, in which a plurality of air flow channels of circular section is provided, the diameter of said section being so small that the air emerges in the form of a turbulent stream.

2. A coupling profile as claimed in claim 1, characterized in that said roller is made from cork.

3. In a building structure, a suspended grid system comprising a plurality of elongate coupling profiles, each coupling profile being of inverted channel configuration and including spaced side wall portions and a top, said top being provided with a series of closely spaced openings along its length and said side wall portions immediately below said top projecting inwardly toward each other but terminating in spaced relation to each other to provide a retainer space extending throughout the length of the coupling profile, said side wall portions immediately below the retainer space projecting inwardly toward each other but terminating in spaced relation to each other to provide inwardly facing retainer channels extending throughout the length of the coupling profile;

an air regulator device which is of small length compared to the length of the one coupling profile and slidably received in said retainer space thereof so as to be positioned at any desired location along the length of the one coupling profile;

a first electric cable strip received in the retainer channel of one leg portion of said one coupling profile and a second electric cable strip received in the retainer channel of the other leg portion of said one coupling profile, each cable strip comprising an insulator strip and at least one conductor carried by the insulator strip, each insulator strip and conductor extending the length of the one coupling profile and each insulator strip having a slot extending throughout its length and exposing the associated conductor therewithin; and an electrical outlet connector disposed between said leg portions and bridging between said conductors whereby an electrical connection may be made at any desired location along the length of the one coupling profile; and an air inlet body selectively mounted on top of said one coupling profile at said location of the air regulator device.

4. In a suspended ceiling system which includes a grid network for supporting ceiling panels, a grid module comprising:

an elongate member adapted to have its ends disposed in abutting relation to other like members together to define the grid network, said member having opposite side wall means defining an inverted channel and including upper wall means joining said side wall means, said upper wall means having a series of regularly spaced vent/access openings along its length, the inner surfaces of said upper wall means and adjacent portions of said side wall means defining a generally semi-circular main channel running the full length of said member and with which said openings directly communicate, the inner surfaces of said side wall means defining mutually opposed retainer channels running the full length of said member immediately below the main channel and on opposite sides thereof, said member including support means extending along the opposite sides of said upper wall means and along the full length of said member for positioning suspension members at any locations along the length of said member, an air plenum casing disposed along the length of said member and supported at a desired location thereon by said support means, an air distribution device slidably received in said main channel in alignment therein immediately below said plenum casing, and a multi-conductor electrical conductor strip received in each of said retainer channels, said strips having continuous slots exposing the conductors whereby electrical connectors bridging between conductor pairs likewise may be positioned at any location along the length of said member.

5. In a building structure having an overhead air supply conduit, an overhead air return conduit, electrical supply mains and further electrical conductors such as telephone conductors, a suspended ceiling system which includes a grid network, disposed below said air supply and return conduits, for supporting ceiling panels, said grid network comprising a plurality of elongate members of similar construction and disposed in abutting relation to define the grid network, each member having opposite side wall means defining an inverted channel and including upper wall means joining said side wall means, said upper wall means having a series of regularly spaced vent/access openings along its length, the inner surfaces of said upper wall means and adjacent portions of said side wall means defining a generally semi-circular main channel running the full length of said member and with which said openings directly communicate, the inner surfaces of said side wall means defining mutually opposed retainer channels running the full length of said member immediately below the main channel and on opposite sides thereof, each member also including support means for securing an air plenum thereto in any longitudinal location along its length, at least one air distribution plenum secured to a member of the grid network in communication with the main channel thereof through a plurality of said openings at the location of such plenum and conduit means extending laterally of the plenum chamber into connection with said air supply conduit for delivering air to the plenum, a cylindrical air distribution device slidably received in the main channel of that member upon which said air supply plenum is mounted and in alignment with said location thereof for diffusing air received from the air supply plenum, an air return plenum secured to a member of the grid network in communication with the main channel thereof through a plurality of said openings at the location of such air return plenum and conduit means extending laterally of the air plenum into connection with said air return conduit for returning air thereto, a pair of multi-conductor electrical connection tapes received in the opposing retainer channels of at least one member of said grid network, the conductors of which are connected to said electrical system, and a plurality of electrical devices including connector means bridging between conductors of said tapes and movably positioned at desired locations along the length of said one member for disposition at desired locations within the building structure.

6. In a building structure as defined in claim 5 wherein said air distribution device is of a length commensurate with the spacing of those openings through which said air supply plenum whereby said air distribution device in cooperation with such openings intercepts all of the air supplied by such plenum.

7. In a suspended ceiling system which includes a grid network for supporting ceiling panels, a grid module comprising:

an elongate member adapted to have its ends disposed in abutting relation to other like members together to define the grid network, said member having opposite side walls and a top wall defining an inverted channel, said top wall having a series of regularly spaced openings along its length, the inner surfaces of said top wall means defining a generally semi-circular main channel running the full length of said member and with which said openings directly communicate, the inner surfaces of said side wall means defining mutually opposed retainer channels running the full length of said member immediately below the main channel and on opposite sides thereof, and said member including support means extending along opposite sides of said top wall means and running the full length of the member; and at least a pair of multi-conductor electrical tapes received in the opposing retainer channels of a member of said grid network and at least electrical connection devices bridging between conductors of said tapes at a desired location along the length of said member, at least one air supply plenum engaging said support means of a member of said grid network and having a discharge mouth spanning a number of said openings whereby to discharge air therethrough into the associated main channel, and a cylindrical air distribution device slidably positioned in such associated main channel to bridge said number of openings to control the flow of air in a downward direction.

* * * * *